US008205776B2

(12) United States Patent
Gandhi et al.

(10) Patent No.: US 8,205,776 B2
(45) Date of Patent: Jun. 26, 2012

(54) DUAL FUNCTION CLIP DEVICE FOR AN ELECTRONIC DEVICE HAVING A SCREEN

(75) Inventors: Harsh Gandhi, Carol Stream, IL (US); Michael Reedy, Chicago, IL (US); Taiwon Choi, Chicago, IL (US)

(73) Assignee: Fellowes, Inc., Itasca, IL (US)

( * ) Notice: Subject to any disclaimer, the term of this patent is extended or adjusted under 35 U.S.C. 154(b) by 379 days.

(21) Appl. No.: 12/651,307

(22) Filed: Dec. 31, 2009

(65) Prior Publication Data

US 2011/0155774 A1 Jun. 30, 2011

(51) Int. Cl.
*A45F 5/00* (2006.01)

(52) U.S. Cl. ..... 224/666; 224/669; 224/930

(58) Field of Classification Search ..... 224/666, 224/667, 668, 669, 670, 930, 269
See application file for complete search history.

(56) References Cited

U.S. PATENT DOCUMENTS

| | | | | |
|---|---|---|---|---|
| 4,113,212 | A | 9/1978 | Coriden | |
| 4,693,444 | A | 9/1987 | Williams et al. | |
| 4,735,394 | A | 4/1988 | Facco | |
| 4,940,204 | A | 7/1990 | Nelson et al. | |
| 5,003,984 | A * | 4/1991 | Muraki et al. | 600/523 |
| 5,385,282 | A | 1/1995 | Chen | |
| 5,620,163 | A | 4/1997 | Wu | |
| 6,003,831 | A | 12/1999 | Coleman | |
| 6,029,871 | A * | 2/2000 | Park | 224/197 |
| 6,286,737 | B1 | 9/2001 | Witley | |
| 6,729,518 | B2 * | 5/2004 | Badillo et al. | 224/578 |
| 6,752,299 | B2 | 6/2004 | Shetler et al. | |
| 7,513,472 | B2 * | 4/2009 | Yang | 248/231.81 |
| 7,878,474 | B1 * | 2/2011 | Richer et al. | 248/351 |
| 8,070,026 | B2 * | 12/2011 | Wadsworth et al. | 224/197 |
| 2003/0089832 | A1 | 5/2003 | Gold | |
| 2006/0175370 | A1 | 8/2006 | Arney | |
| 2006/0237495 | A1 | 10/2006 | Chen | |
| 2007/0125814 | A1 | 6/2007 | Roh | |
| 2008/0314941 | A1 * | 12/2008 | Knych et al. | 224/191 |
| 2009/0120980 | A1 * | 5/2009 | Calayo | 224/257 |
| 2011/0031287 | A1 * | 2/2011 | Le Gette et al. | 224/101 |

OTHER PUBLICATIONS

International Search Report and Written Opinion for International Patent Application No. PCT/US2008/066264, mailed Oct. 31, 2008.

(Continued)

*Primary Examiner* — Justin Larson
(74) *Attorney, Agent, or Firm* — Pillsbury Winthrop Shaw Pittman LLP

(57) ABSTRACT

A dual function clip device for an electronic device having a screen has a body for receiving the electronic device, a clip mechanism with an arm movable relative to the body, and a viewing position support mechanism. The arm is pivotally movable about an axis in a first longitudinal position. The arm and its pivot axis is also movable longitudinally along a longitudinal axis of the device to at least one second longitudinal position where it may pivot open about the pivot axis. When the arm is open in the second longitudinal and open pivoted position, the clip device may be positioned to engage an upwardly facing flat surface so that the electronic device may be oriented to a viewing position to display its screen. A release lock and securement device are used for retaining the arm and for viewing position support. A method for displaying the screen is also described.

23 Claims, 12 Drawing Sheets

OTHER PUBLICATIONS

Product Information Sheet, Clip & Carry "Holster that Weapon", accelerate magazine, TECHNOCEL, p. 18 (date unknown).
Website Information Sheet for MyFi Belt Clip Stand, Mar. 7, 2007, obtained from url: <http://www.satelliteradioexperts.com/Delphi-MyFi-Belt-Clip-Stand_p_16-128.html>.
Website Information Sheet for Acrylic iPhone Case from Belkin, Jun. 19, 2007. obtained from url: <http://www.iphonefreak.com/2007/06/acrylic_iphone_.html>.
Website Information Sheet for Brenthaven Flip Case for iPod 60/80GB, Dec. 8, 2006, obtained from url: <http://www.store.apple.com/1-800-MY-APPLE/WebObjects/AppleStore.woa>.
International Preliminary Report on Patentability for PCT International Patent Application No. PCT/US2008/066264, mailed on Jun. 14, 2010.

* cited by examiner

DUAL FUNCTION CLIP DEVICE FOR AN ELECTRONIC DEVICE HAVING A SCREEN

BACKGROUND

1. Field of Invention

The present invention is generally related to a clip device for use with an electronic device having a screen. More specifically, the invention relates to a detachable, improved dual function clip device for carrying an electronic device on a clothing article and for displaying the screen of the electronic device in a partially vertical or inclined viewing position with respect to a flat surface.

2. Related Art

Manufacturing companies of portable, electronic devices, such as cellular phones and personal digital assistants (PDAs), for example, are integrating music and/or video capabilities into such devices. Also, many known music or MP3 players are incorporating video capabilities. The user may need to view the screen to watch a video and have the need to interact with the screen of the electronic device (e.g., using a touchpad, viewing incoming calls, viewing a clock feature).

Devices for carrying portable, electronic devices such as cell phones and PDAs are known for removably attaching the electronic device to a user's body via a clip that is attached to a belt or an article of clothing. These devices generally do not assist in displaying the screen of the electronic device.

Generally, if a user wanted to watch a video on a cell phone, for example, the user is required to hold the phone in their hand or lean it against an object on a flat surface. Additionally, prior art devices for displaying electronic devices on the surface of a desk or a table, for example, include easels or stands in which the electronic device is seated on or within a base. Other display devices include protecting carrying cases having an opening in which the electronic device is removed from the case and placed within the opening to vertically position the screen of the electronic device. One example of a clip device that may also serve as a stand is the "MyFi Belt Clip Stand" by Delphi. Technocel also offers holstering devices. Other examples of prior devices include U.S. Patent Application Publications 2003/089382 A1, 2006/237495 A1, and 2007/125814 A1, and U.S. Pat. No. 5,385,282.

SUMMARY

One aspect of the invention provides a dual function clip device for use with an electronic device having a screen. The clip device has a body for receiving the electronic device and a clip mechanism constructed and arranged to clip onto a peripheral edge of a clothing article of a user. The clip mechanism has an arm having a top portion and a bottom portion. The arm is configured to be movable in a longitudinal direction with respect to the mount between a first longitudinal position and at least one second longitudinal position. The arm is pivotally movable (a) in the first longitudinal position such that the top portion of the arm pivots about a pivot axis from a pivoted closed position to a first pivoted open position to receive the peripheral edge of the clothing article at the bottom portion, and (b) in the at least one second longitudinal position such that the top portion of the arm pivots about the pivot axis to at least one second pivoted open position to position the electronic device for viewing using a viewing position support mechanism. The viewing position support mechanism has a release lock which releasably retains the arm in the first longitudinal position. The viewing position support mechanism is constructed and arranged such that at least the bottom portion of the arm in the at least one second pivoted open position is positioned to engage an upwardly facing flat surface and orient the mount for supporting the electronic device in a viewing position to display the screen on the electronic device.

Another aspect of the invention provides an attachment device for a portable electronic device having a screen. The attachment device has a body for receiving the electronic device and a clip mechanism attached to the body. The clip mechanism is constructed and arranged to clip onto an edge of a clothing article and has an arm that is movable relative to the body. A viewing position support mechanism is configured to allow movement of the arm relative to the mount in a longitudinal direction and pivotally about a pivot axis. The arm and its pivot axis are configured to be moved in the longitudinal direction between a first longitudinal position and at least one second longitudinal position. The first longitudinal position allows for pivoting of the arm to a first predetermined angle with respect to the body about the pivot axis to allow the clip mechanism to receive the clothing article, and the at least one second longitudinal position allows for pivoting of the arm to a second predetermined angle with respect to the mount about the pivot axis, such that when the clip device is positioned on an upwardly facing flat surface, the body is oriented to display the screen of the electronic device at an angle with respect to the surface.

Yet another aspect of the invention includes a method for displaying a screen of an electronic device using a clip device constructed and arranged to clip onto a peripheral edge of a clothing article of a user. The clip device has a body, a clip mechanism with a movable arm for receiving the clothing article, and a viewing position support mechanism. The method includes: mounting an electronic device on the body of the clip device; moving the movable arm in a longitudinal direction downwardly relative to the body from a first longitudinal position to a second longitudinal position, the first longitudinal position of the arm configured to allow the clip mechanism to receive the peripheral edge of the clothing article; pivoting the movable arm in the second longitudinal position about a pivot axis to a pivoted open position, the pivot axis being perpendicular to the longitudinal direction; releasably securing the arm in the pivoted open position by engaging a first lock member of the arm with a second lock member associated with the viewing position support mechanism; engaging the arm with an upwardly facing flat surface, and orienting the body to display the screen of the electronic device in an at least partially vertical viewing position relative to the upwardly facing flat surface.

Other objects, features, and advantages of the present invention will become apparent from the following detailed description, the accompanying drawings, and the appended claims.

DETAILED DESCRIPTION OF THE ILLUSTRATED EMBODIMENT(S)

Figure 1:
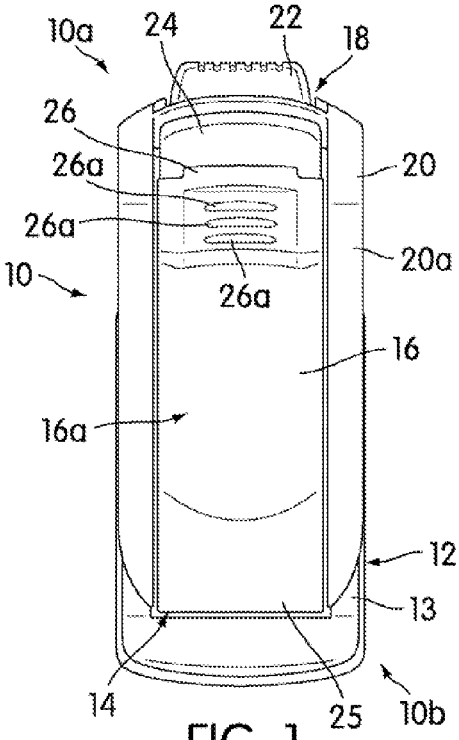
FIGS. 1-5 illustrate a back, front, side, top, and bottom views, respectively, of an improved dual function clip device in accordance with an embodiment of the present invention.
Figure 2:
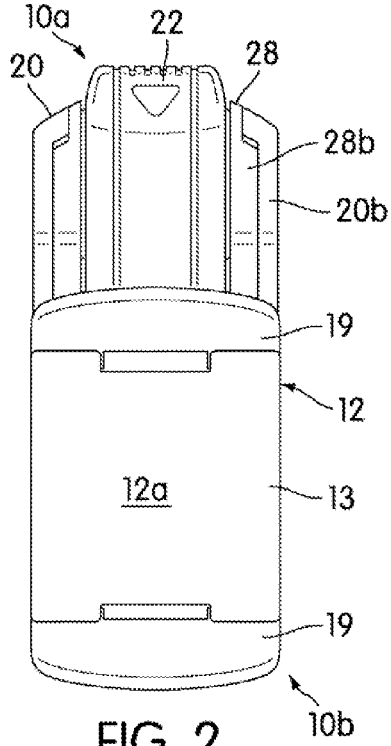
Figure 3:
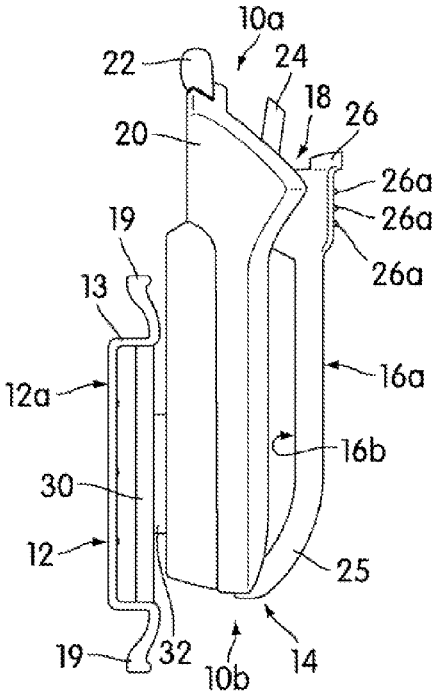
Figure 4:
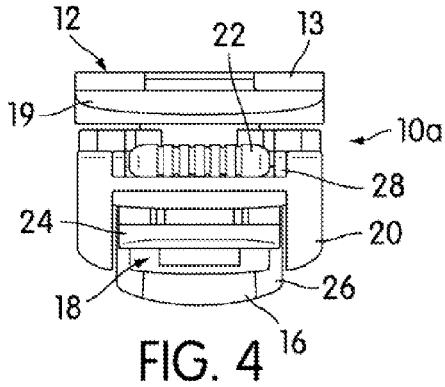
Figure 5:
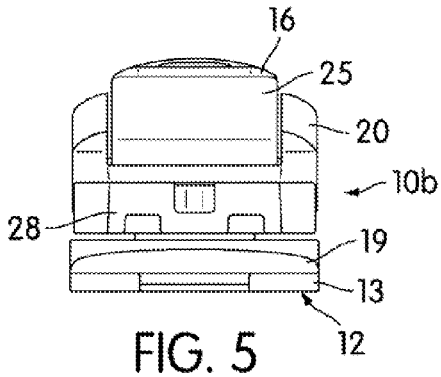

The following describes an improved dual-function clip device that is for use with an electronic device having a screen which allows the device to be attached to an article of clothing as well as positioned for viewing on a surface. U.S. patent application Ser. No. 11/766,402, filed on Jun. 21, 2007 and assigned to the same assignee, is hereby incorporated by reference in its entirety. As will become further evident, features described in the '402 application may be provided on the clip device described herein.

FIGS. 1-5 illustrate a back, front, side, top, and bottom views, respectively, of an improved dual function clip device 10 in accordance with an embodiment of the present invention. The clip device 10 has a top end 10*a* and a bottom end 10*b*. The clip device 10 comprises a mount 12, clip mechanism 14 and viewing support mechanism 18 with arm 16. The clip device 10 is a detachable device that may be used for carrying an electronic device (such as device 100, shown in FIG. 10) on a user. Generally, the clip device 10 may be formed using processes such as injection molding. In an embodiment, the clip device 10 is preferably injection-molded plastic.

The mount 12 is designed to receive an electronic device (e.g., see FIGS. 10-12B) such as a cellular phone, PDA, MP3 player, etc., that has a screen for displaying or viewing. In an embodiment, the mount 12 comprises an attachment piece or body 13 for connecting the electronic device to the clip device 10 for porting or carrying, for example. The attachment piece or body 13 of the mount 12 has a first surface 12*a* and a second surface 12*b*. First surface 12*a* may be an outer surface and second surface 12*b* may be an inner surface. The body 13 also allows a user to detach the electronic device from the clip device 10 (e.g., during use). More specifically, in embodiments, the attachment piece or body 13 comprises a retaining clip with arms 19. The arms 19 may be provided on a top and bottom portion of the clip and extend toward the location of the electronic device and away from the clip mechanism 14. Arms 19 may be used in cooperation with a mount or a rotatable attachment device 30. In embodiments, the attachment piece or body 13 comprises a rotatable attachment device 30 for allowing the user to position and rotate the electronic device with respect to the mount 12 (e.g., allowing the user to rotate the electronic device 360 degrees). For example, the attachment piece or body 13 may comprise a plate portion 31 and a rotational knob portion 32. A rotational knob portion 32 is designed to allow for rotation of at least the device 30 about an axis in one or more directions (e.g., clockwise and/or counterclockwise) with respect to the clip mechanism 14 (further described below). In an embodiment, knob portion 32 includes an attachment opening and one or more indentations (e.g., see FIG. 6). In an embodiment, the attachment opening may be used to secure the knob portion 32 to the clip mechanism 14. In an embodiment, the indentation(s) may be used with a locking mechanism (e.g., on clip mechanism 14) to at least temporarily secure the rotatable attachment device 30 in different positions (or angles) when it is rotated about its axis.

The plate portion 31 and knob portion 32 may be attached thereto or formed as an integral part of the attachment piece/body 13. For example, in some embodiments, the plate portion 31 may be formed separately from the electronic device attachment piece and be snap-fit or friction-fit into the mount 12. For example, as shown in detail in FIG. 6, the plate portion 31 may have tabs 33 formed at its ends which are designed to fit into openings 21 in the mount 12. Thus, the plate portion 31 may be inserted and fit into an area formed by the locking arms 19 on the first or outer side 12*a* of the mount 12.

Figure 10:
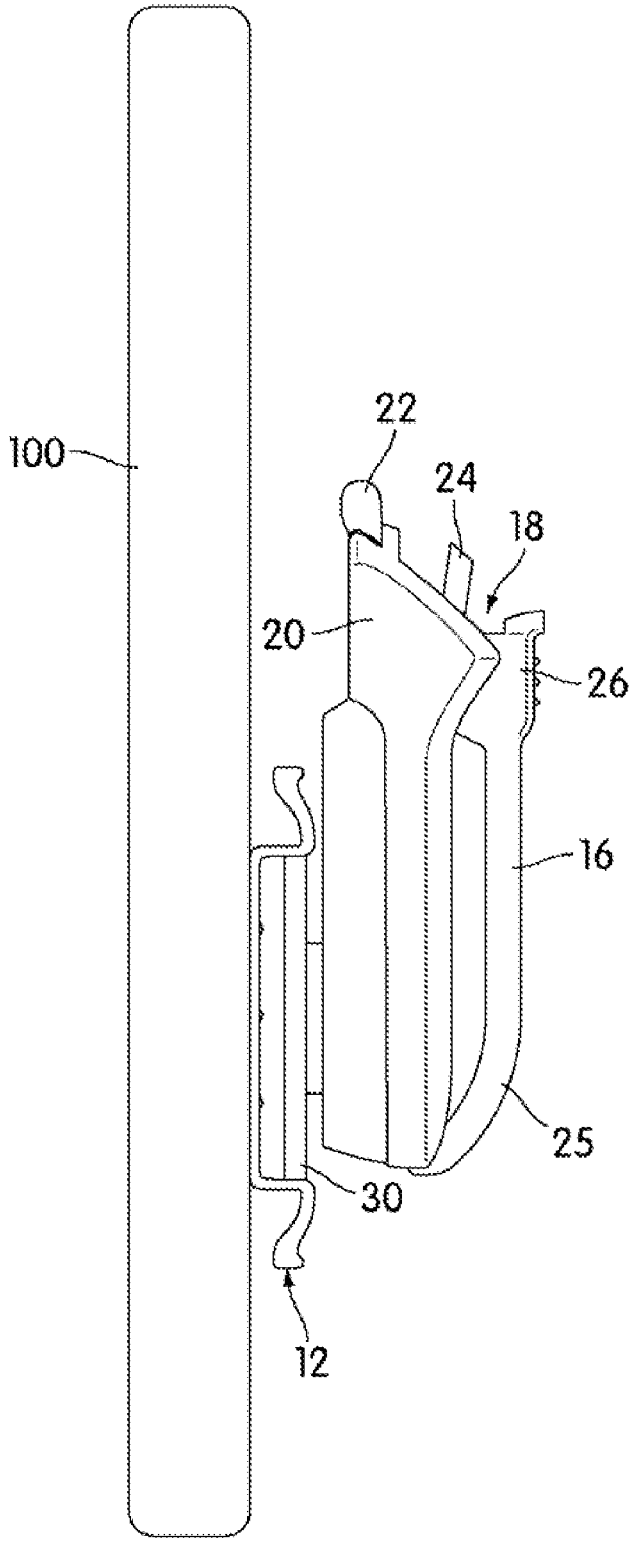
FIG. 10 illustrates a side view of the clip device of FIGS. 1-5 in a pivoted closed position with an electronic device attached thereto in a partially vertical position in accordance with an embodiment.

Arms 19 may be used to release and/or secure the rotatable attachment device 30 with respect to an electronic device 10. When plate portion 31 is secured in mount 12, arms 19 may assist in holding or securing the device. For example, in an embodiment, mount 12 may be provided on a back of an electronic device either directly or using a separate case (e.g., a silicone cover). When the mount 12 is positioned on a back of an electronic device, such as shown in FIG. 10, the arms 19 extend from its body. In the instance where a case is used with an electronic device, the arms 19 may be inserted through openings of the case such that the body 13 is on a first (inner side) of the case and at least a portion of each of the arms 19 are accessible on the second (outer) side of the case. The plate portion 31 can be attached to the electronic device on the second (outer) side of the case by snapping, sliding, or inserting tabs 33 into the openings 21 of the mount 12 (e.g., via the openings of the case). For example, the tabs 33 may be snap-fit into the openings 21. The arms 19 can be used to release the tabs 33 by squeezing the arms 19 in a direction towards each other or apart from each other (depending on their design). Thus, the arms 19 may have some flexibility and/or resiliency. In an embodiment, the electronic device is taken from the case before releasing the tabs 33 of the rotatable attachment device 30. In an embodiment, the design of the arms 19 (e.g., their angle(s) or positioning with respect to body 13) can hinder or prevent release of the plate portion 31 unless the electronic device 10 is removed from the case.

However, the above-described structure is not intended to be limiting and any retainer or attachment device suitable for releasably retaining an electronic device may be used. For example, in an embodiment, the mount 12 may be non-rotating, permanently attached to the electronic device, or made for other known electronic devices such as a GPS device or satellite radio.

In embodiments, the mount 12 is attached to the clip mechanism 14. In some cases, mount 12 may be permanently attached. In some embodiments, the plate portion 31 and/or knob portion 32 provided on the rotatable attachment device 30 may be used to attach or lock the mount 12 to the clip mechanism 14. For example, the plate portion 31 and/or knob 32 may be slid into an interlocking relationship with clip mechanism 14 such that it will frictionally lock within a recess (e.g., a corresponding recess) on clip mechanism 14. In the disclosed and illustrated embodiment, the knob portion 32 is designed to removably connect the body 13 of the mount 12 (and thus the electronic device 100) to the clip mechanism 14. Thus, the rotatable attachment device 30 is attached to the clip mechanism 14, and the mount 12 is attached to the device 30. In an embodiment, the action of sliding and locking the knob portion 32 to the clip mechanism 14 is non-reversible, such that when the mount 12 is locked in the recess of the clip mechanism 14, it is not able to slide in an opposite direction along the path of insertion. In an embodiment, the clip mechanism 14 is temporarily locked and is capable of being disengaged from the mount 12, such that numerous types of mounts 12 may be attached to the clip mechanism 14, either during the manufacturing process or by a user, for example. In an embodiment, the mount 12 may be interlocked to the clip mechanism 14 using any known mating or locking feature.

Referring more specifically to the Figures, the clip mechanism 14 is formed from a plurality of parts. The clip mechanism 14 has front or outer surface and back or inner surface. The clip mechanism 14 is constructed and arranged to clip onto a peripheral edge of a clothing article such as a belt or a shirt of a user via an arm 16. More specifically, as and further described in FIG. 7A, the arm 16 may be used to pivotally or rotatably open part of the clip mechanism 14 relative to the mount 12 such that a user may insert at least a peripheral edge of a clothing article in between a second or an inner surface 16*b* of the arm 16 and a first or outer surface 20*a* of a first part 20 of the device. The arm 16 may be resiliently biased such that the mechanism 14 will return to its original position for gripping the clothing article, for example.

The arm 16 of the clip mechanism 14 has a bottom portion 25 and a top portion 26 and a first or outer side 16*a* and a second or inner side 16*b*. In embodiments, the bottom portion 25 of the arm 16 may have one or more protrusions or teeth to provide a frictional gripping surface against an article of clothing, for example. In the exemplary embodiment shown in FIG. 6, for example, the top portion 26 has a pair of extensions 46 with pins 48 at their ends for attaching and connecting the arm 16. The extensions 46 and pins 48 also assist in moving the arm 16 relative to the mount 12. The top portion 26 of the outer surface of the arm 16 may also comprise a gripping surface comprising, for example, a plurality of ridges 26*a*. The gripping surface 26*a* may be provided as an aid to provide a frictional surface for hingedly opening the arm 16 of the clip mechanism 14 to attach the clip device to an article of clothing. Specifically, when the arm 16 is in a pivoted closed position, for example, a user can push against the surface 26*a* to assist in opening the mechanism 14. When a user attached the clip device 10 to an article of clothing, the first or outer surface 16*a* of the arm 16 (and thus the clip mechanism 14) is provided against a user's body, for example. As described below, in embodiments, the ridges of the gripping surface 26*a* may be used to assist in securing the arm 16 in at least one second longitudinal position. The gripping surface 26 may also be used to assist in easing the release of the release lock 28 on the arm 16 from the top of the clip mechanism 14 before moving the arm 16 in a longitudinal direction into at least one of the second longitudinal positions.

The arm 16 is movable in a longitudinal direction relative to the mount 12. The arm 16 is also longitudinally movable relative to a first part 20 and a second part 28. The arm 16 is configured to be movable in a longitudinal direction with respect to the mount 12 between a first longitudinal position and at least one second longitudinal position of the clip device 10. The arm 16 is also releasably retained in a first longitudinal position such that the top portion 26 of the arm 16 pivots about a pivot axis A-A from a pivoted closed position (e.g., see FIG. 7) to a first pivoted open position (e.g., see FIG. 7A) to receive the peripheral edge of the clothing article at the bottom portion 25, and in the at least one second longitudinal position such that the top portion of the arm pivots about the pivot axis to at least one second pivoted open position (e.g., see FIG. 8) to position the electronic device for viewing using a viewing position support mechanism. Further description regarding such positions and the method for moving the arm is provided below.

The viewing position support mechanism 18 is constructed and arranged such that at least the bottom portion 25 of the arm 16 in at least one second pivoted open position is positioned to engage an upwardly facing flat surface, such as a desk or table top, and orient the mount 12 for supporting the electronic device in an at least partially vertical viewing position to display the screen on the electronic device. The viewing position support mechanism 18 also comprises a release lock 24 which releasably retains the arm 16 between the first longitudinal position and the at least one second longitudinal position with respect to the mount 12. The release lock 24 may be provided near the top end 10*a* of the clip device, such as near the top portion 26 of the arm 16. As shown in greater detail in FIG. 6, the release lock 24 may comprise a contact portion 50 with extended lock arms 52. The lock arms 52 include formed ends 52*a* for holding the release lock 24 in position in the housing of the clip device 10. The lock arms 52 also include receiving members 54 in the form of indentations on the arms 52. The receiving members 54 of the lock 24 may be positioned near a top portion 26 of the arm 16 such that they may cooperatively receive pins 48 on extensions 46 of the arm 16 therein. When the arm 16 is in the pivoted closed and first longitudinal positions, the arm 16 is retained by the release lock 24. Specifically, such as described shown in FIGS. 7 and 7A, the pins 48 are positioned to engage the receiving members 54, and thus the arm 16 is capable of rotation about a pivot axis A1-A1.

The cooperative engagement of the pins 48 and receiving members 54 is releasable by applying a pressure to the contact portion 50. To allow movement (e.g., sliding) of the arm 16 to the second longitudinal position, the release lock 24 may pressed via contact portion 50, which in turn moves and lowers the receiving members 54. This allows engagement pins 48 of the arm 16 to be moved (e.g., to disengage from receiving members 54), and thus the arm 16 may be moved (e.g., slid) when grasped or pulled by a user.

The housing of the clip device 10 is formed from an assembly which comprises a first part 20 and a second part 28 which house or enclose the parts of the clip mechanism 14 and viewing position support mechanism 18. The first part 20 comprises an opening 42 surrounded by a plurality of walls which form housing 44. The opening 42 allows access to parts of the clip mechanism 14 and viewing position support mechanism 18 via the first or outer side of the part 20 when assembled. The second or inner side 20*b* of the part is connected to a first side 28*a* (or outer side) of the second part 28 to form an enclosure. In some cases, the first part 20 and second part 28 may be snap-fit together such that their second sides 20*b* and 28*b*, respectively, are flush and form a flat configuration. For example, the side walls of the housing 44 may enclose the side walls of the part 28.

In embodiments, the second part 28 may also include a slide release device 22 for attaching the mount 12 (or at least the rotatable attachment device 30) to the clip mechanism 14 of the clip device 10. The slide release device 22 comprises an elongated body 36 with a top part 34 and a bottom part 38. The top part 34 comprises a contact portion 34*a* which allows a user to push the device 22 downwardly with respect to the second part 28. The bottom part 38 of the body 36 comprises an opening or hole 40 for receiving a lock device. The slide release device 22 cooperates with a wall 62 of the second part 28 to lock the mount 12 thereto. Specifically, the wall 62 comprises one or more lock devices or pins (not shown) extending from the second or inner side 28*b* near a bottom portion thereof. One lock device or pin (not shown) may be positioned on the wall 62 such that it extends into the hole 40 of the elongated body 36 of the slide release device 22. One or another lock device or pin (not shown) may be positioned on the wall 62 such that it extends into the opening of knob 32 to keep the rotatable attachment portion 30 and mount 12 attached thereto in place. Additional protruding piece(s) may be provided on wall 62 to interact with indentations on knob plate 32, thereby providing a locking mechanism when the knob plate 32 is rotated about its axis to different positions. When the rotatable attachment device 30 or mount 12 is slid onto/connected with the second part 28, the pin(s) (not shown) extends toward the device 30 or mount 12.

The action of applying pressure to the contact portion 34*a* moves the elongated body 36 of the slide release 22 downwardly, such that the lock piece or pin of the wall 62 may be pushed or pivoted from the hole 40 and out of engagement. Additionally and/or alternatively, the pressure (e.g., pushing) of the slide release 22 may cause hole 40 to push the pin on wall 62, thereby allowing the mount 30 (e.g., via knob portion 32) to disengage. As such, the electronic device may be removable with the mount 12 from the clip mechanism 14 via moving the slide release device 22 in the longitudinal direction of the clip device 10.

Figure 6:
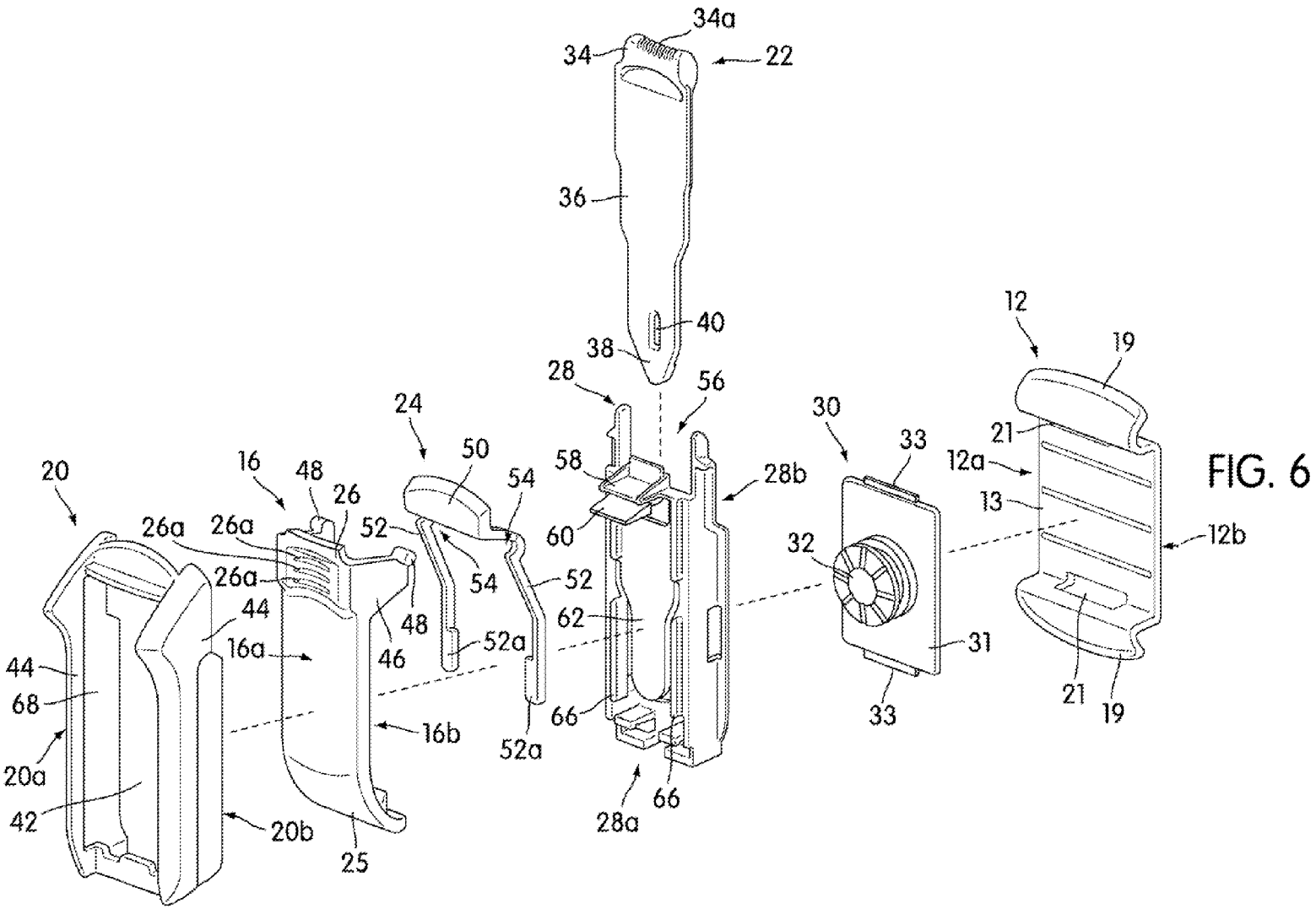
FIG. 6 illustrates an exploded view of the clip device of FIGS. 1-5.
Figure 7B:
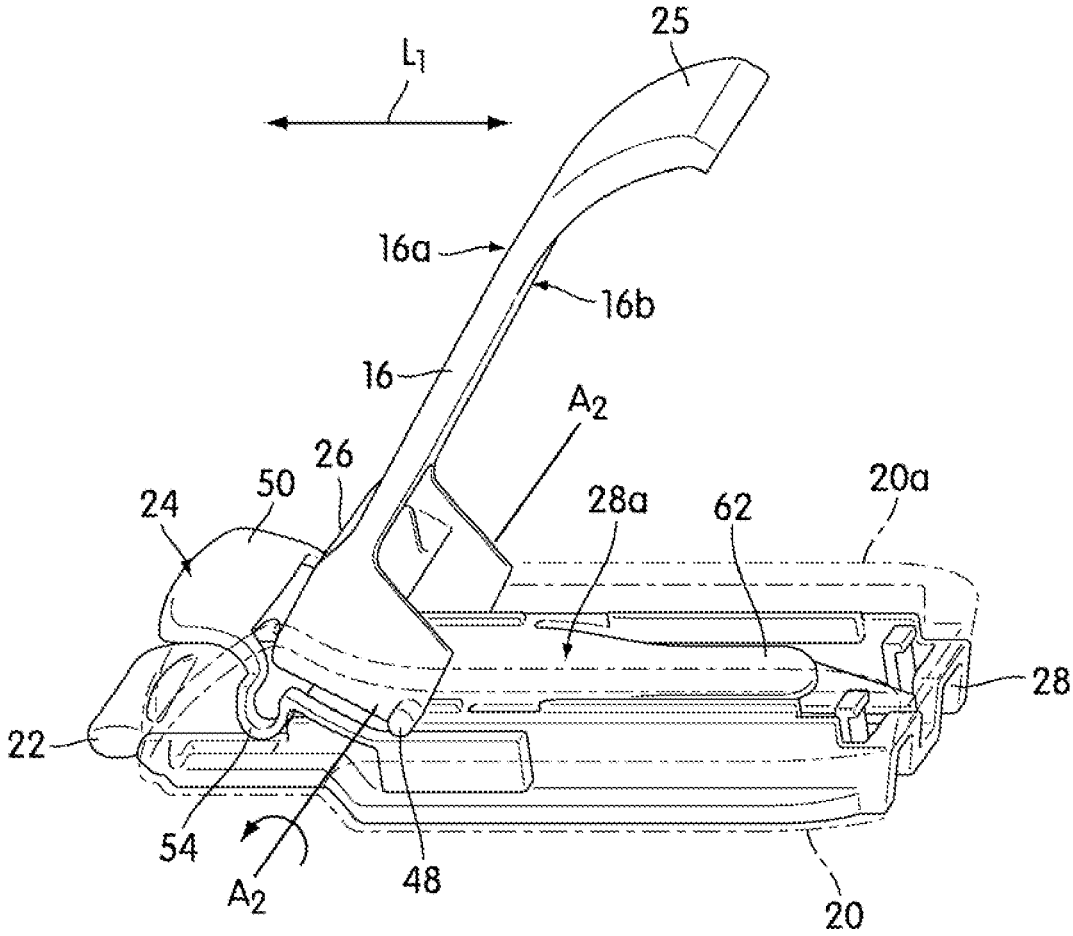
FIG. 7*b* illustrates a plan view of the clip device of FIGS. 1-5 being pivoted about the pivot axis in a second longitudinal position in accordance with an embodiment.
Figure 8:
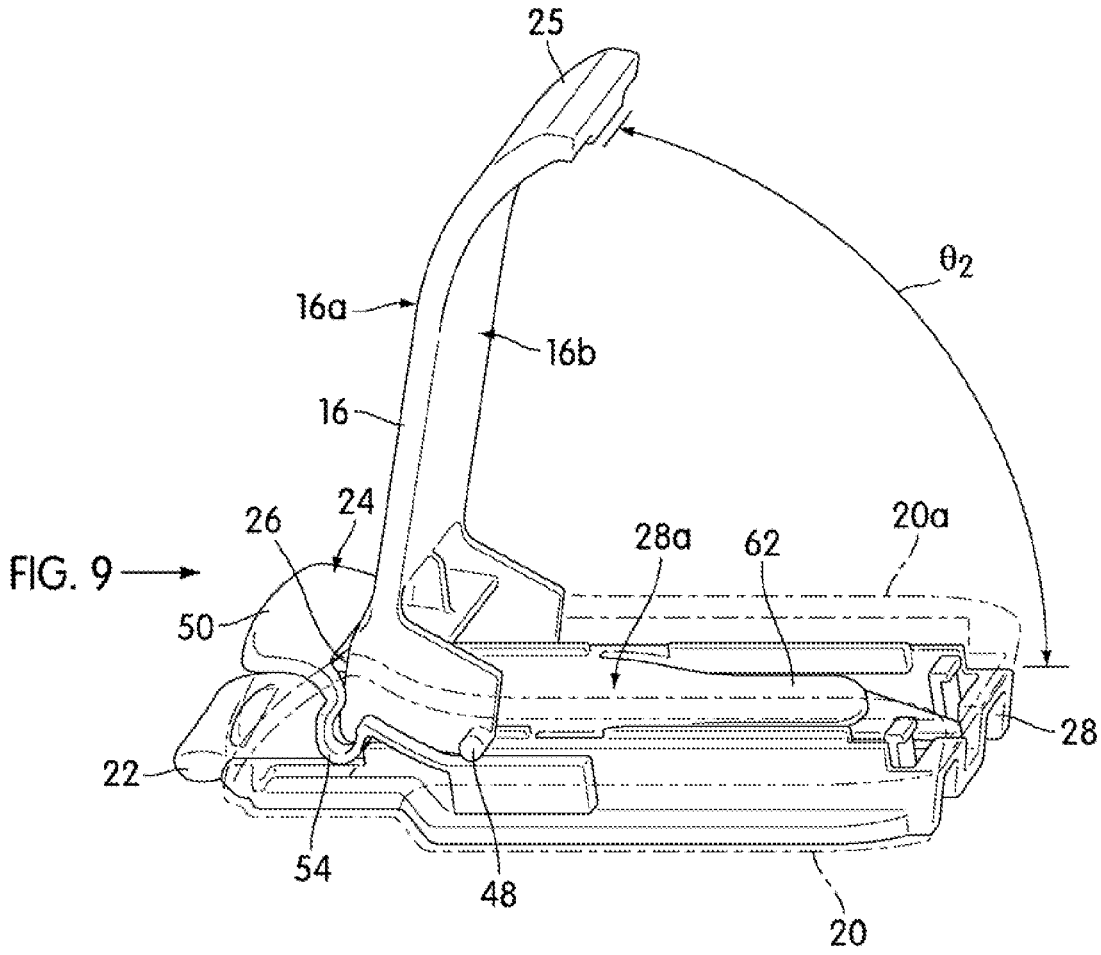
FIG. 8 illustrates a plan view of the clip device of FIGS. 1-5 pivoted to a second pivoted open position in accordance with an embodiment.

Additionally, the second part 28 may comprise parts of the viewing position support mechanism 18. As shown in FIG. 6, for example, the viewing position support mechanism 18 may comprise a stop element 58 and a securement device 60 that extends from the first or outer side 28*a* of second part 28. Stop element 58 is a stopper for securement device 60. Stop element 58 is provided to ensure that the securement device 60 does not move past a specific point (i.e., a location that the stop element 58 is provided in), because movement beyond the point may cause deformation of one or more parts of the device if no stop element 58 was provided. The securement device 60 may be used to secure the arm 16 in one of the at least one second longitudinal position. In embodiments, the securement device 60 may comprise an engagement member 64 (e.g., see FIG. 8A) for engaging and assisting in securing the arm 16 in a second longitudinal position. In some cases, an edge of the engagement member 64 may be used to engage a portion of the arm 16. For example, an edge of the engagement members 64 may engage with a ridge of the gripping portion 26*a*. As shown in FIGS. 7B and 8, the arm 16 may be configured to be rotated about a pivot axis A2-A2 such that the top portion 26 of the arm 16 is secured by the securement device 60 by allowing the top portion 26 and/or at least one of the ridges 26*a* of the gripping portion to be in contact with and engage at least an edge of the engagement member 64. FIG. 9 illustrates a top view of the arm 16 when secured by the securement device 60 in a second longitudinal position as shown in FIG. 8. Specifically, the top portion 26 of the arm and at least one of its ridges 26*a* is secured under a bottom edge of the engagement member 64.

The viewing position support mechanism 18 may also comprise a plurality of longitudinal channels that are formed from the connection of the second part 28 and the first part 20. More specifically, when the chasses are attached, inner extended walls 66 on the left and right sides of the second part 28 may be spaced from the left and right inner walls 68 of the first part 20 to form channels therebetween on the inside thereof. The channels may be designed such that they are able to receive and hold pins 48 on either side of the arm 16, and allow for movement of the pins 48 along the length of the clip device 10 in the longitudinal direction. Thus, the arm 16 and the location of pivot axis A-A may be moved in a longitudinal direction to at least one second longitudinal position.

Figure 7:
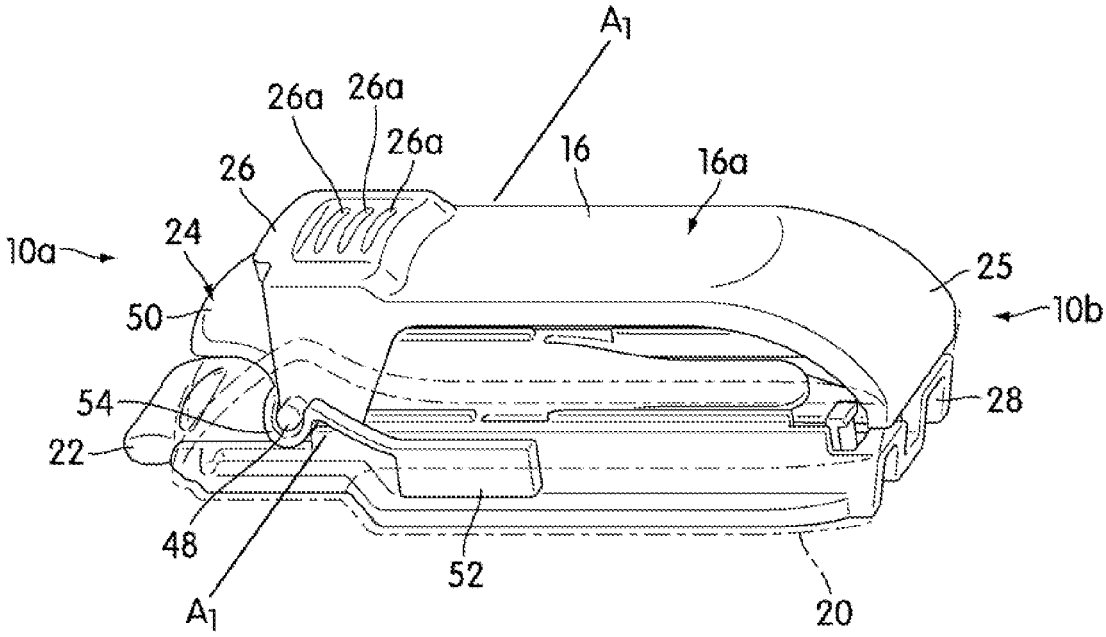
FIG. 7 illustrates a plan view of the clip device of FIGS. 1-5 in a pivoted closed position.

Referring to more specifically to FIGS. 7, 7A, 8, 8A, and 9, the movement of the arm 16 in first and second longitudinal position is more specifically shown. FIG. 7 illustrates the clip device 10 with the arm 16 in a pivoted closed position. For clarity purposes only, the first part 20 housing is shown in phantom lines so that the movement of the arm 16 with respect to the release lock 24 and length in the longitudinal direction of the device 10 is better illustrated. Also, mount 12 and electronic device 100 are not provided in these Figures to also allow for better illustration of the device 10.

Figure 7A:
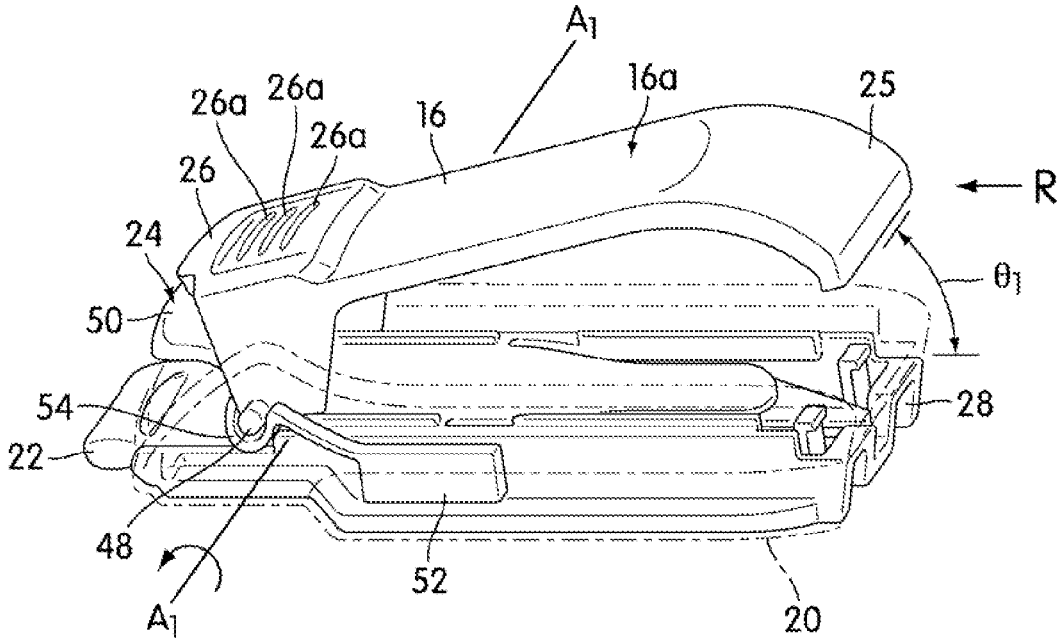
FIG. 7*a* illustrates a plan view of the clip device of FIG. 7 pivoted about a pivot axis in a first longitudinal position to a first pivoted open position in accordance with an embodiment.

In order to attach the clip to a piece of clothing, the use may apply pressure to the gripping portion 26*a* thereby pivoting the arm 16*a* about pivot axis A1-A1. As can be seen in FIG. 7A, the pins 48 on the extensions 46 of the arm are rotated and maintained in the indentations of the arms 52 of the release lock 24. The release lock 24 biases the pivoting of the arm 16 about the pivot axis A1-A1 to a first predetermined angle Θ1 with respect to the mount. The predetermined angle Θ1 may be set to any number of degrees that allows for the insertion of at least a peripheral edge of a clothing article in the direction as indicated by arrow R, at the bottom portion 25 or bottom end 10*a* of the clip device 10. The clothing article would be secured between the second or inner surface 16*b* of the arm and the first or outer surfaces 20*a*, 28*a* of the upper and second part 20, 28, respectively. The release lock 24 also assists in biasing the second or inner surface 16*b* of the arm 16 towards the pivoted closed position.

In order to view the electronic device, the arm 16 is released from its bias. Specifically, the pins 48 of the arm are released from the indentations 54 of the release lock 24 by applying pressure to the contact portion 50. The arm 16 is then free to move via pins 48 in the channels formed by the chasses 20, 28 to a second longitudinal position along the length of the clip device 10. More specifically, as shown in the example of FIG. 7B, the arm 16 may be moved from the first longitudinal position shown in FIG. 7A downwardly in the longitudinal direction a length L1 towards the bottom end 10*b* of the clip device 10 to a second longitudinal position, thereby moving the location of the pivot axis A-A to that of A2-A2. The arm is then rotatable about pivot axis A2-A2. In some cases, such as shown in FIG. 7B, the arm 16 may be at least partially pivoted open to further ease the longitudinal movement to the second longitudinal position. The arm 16 may be pivoted to a second predetermined angle Θ2 with respect to the mount 12 as shown in FIG. 8 in the second longitudinal and pivoted open position, and secured via the securement device 60 of the viewing position support mechanism 18.

Figure 8A:
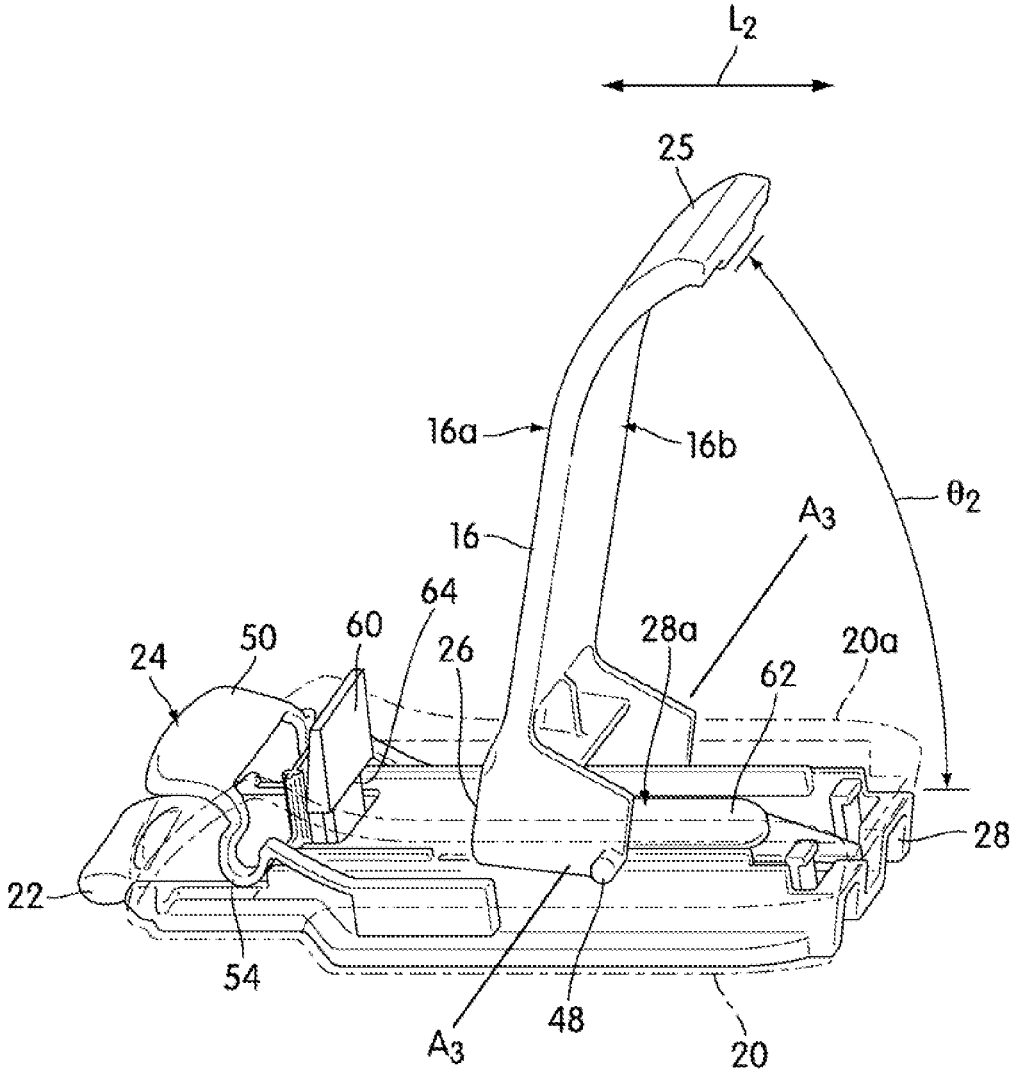
FIG. 8*a* illustrates a plan view of the clip device of FIGS. 1-5 wherein the arm is moved longitudinally and the arm is pivoted to a third pivoted open position in accordance with an embodiment.
Figure 9:
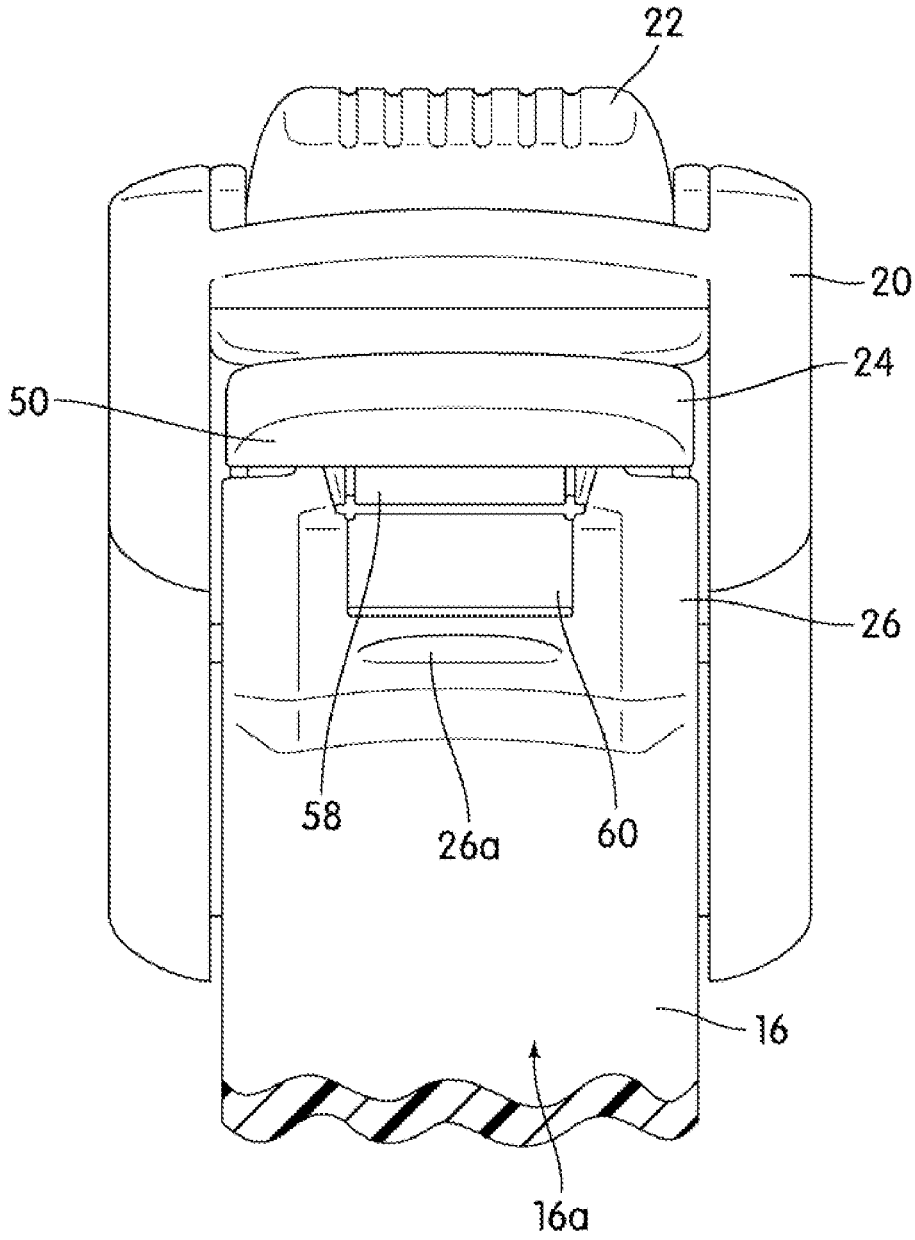
FIG. 9 illustrates a top view of the clip in the second pivoted open position as shown in FIG. 8.

FIG. 8A illustrates a third or alternate second longitudinal position for moving the arm 16 for positioning the clip device 10 on a support surface. In this case, the arm 16 is moved a length L2 in the longitudinal direction of the clip device 10. The pivot axis A-A is moved to a position such that the arm may pivot around pivot axis A3-A3. However, the angle at which the arm 16 is opened with respect to the mount 12 remains the same. That is, the arm 16 may then be pivoted to a pivoted open position to a second predetermined angle Θ2.

Figure 11:
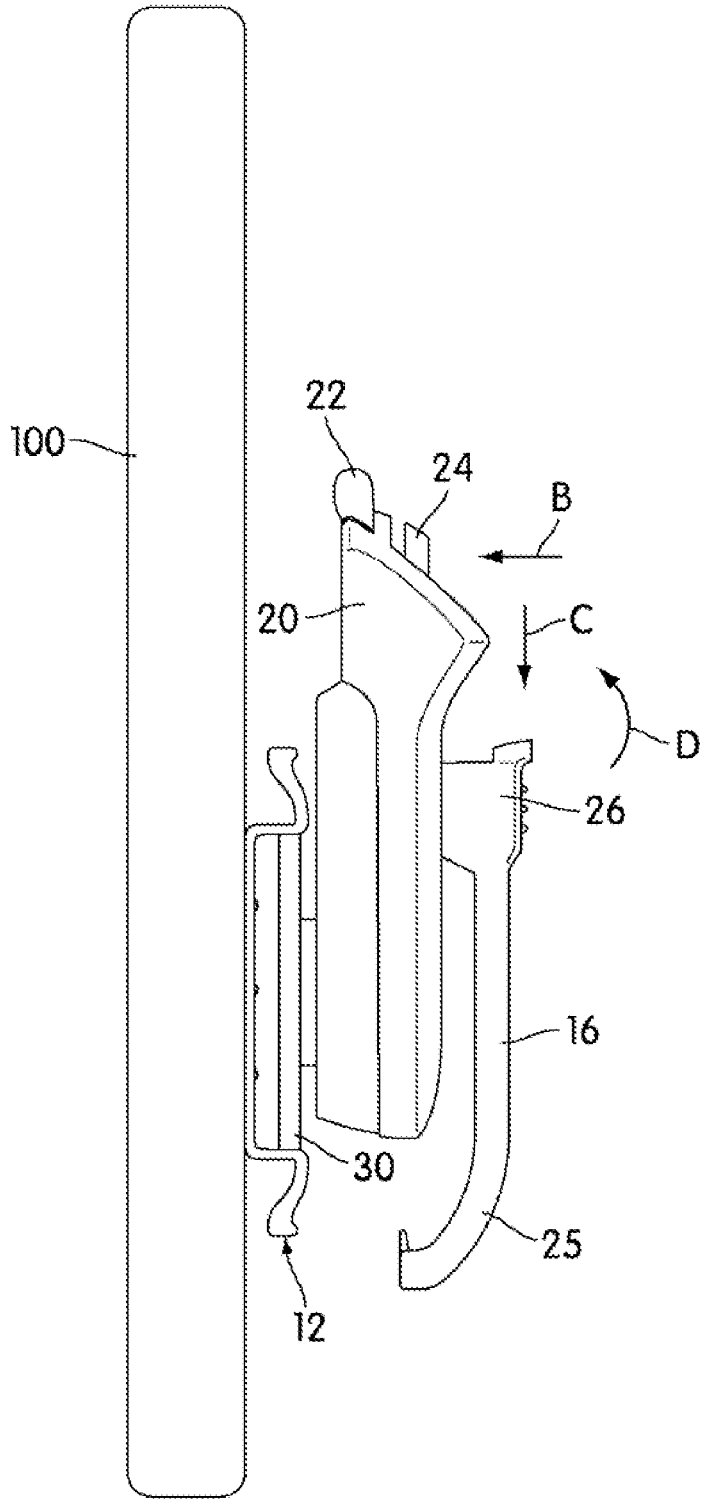
FIG. 11 illustrates a side view of the clip device of FIGS. 1-5 with the arm being moved to a second longitudinal position with an electronic device attached thereto in accordance with an embodiment.
Figure 12A:
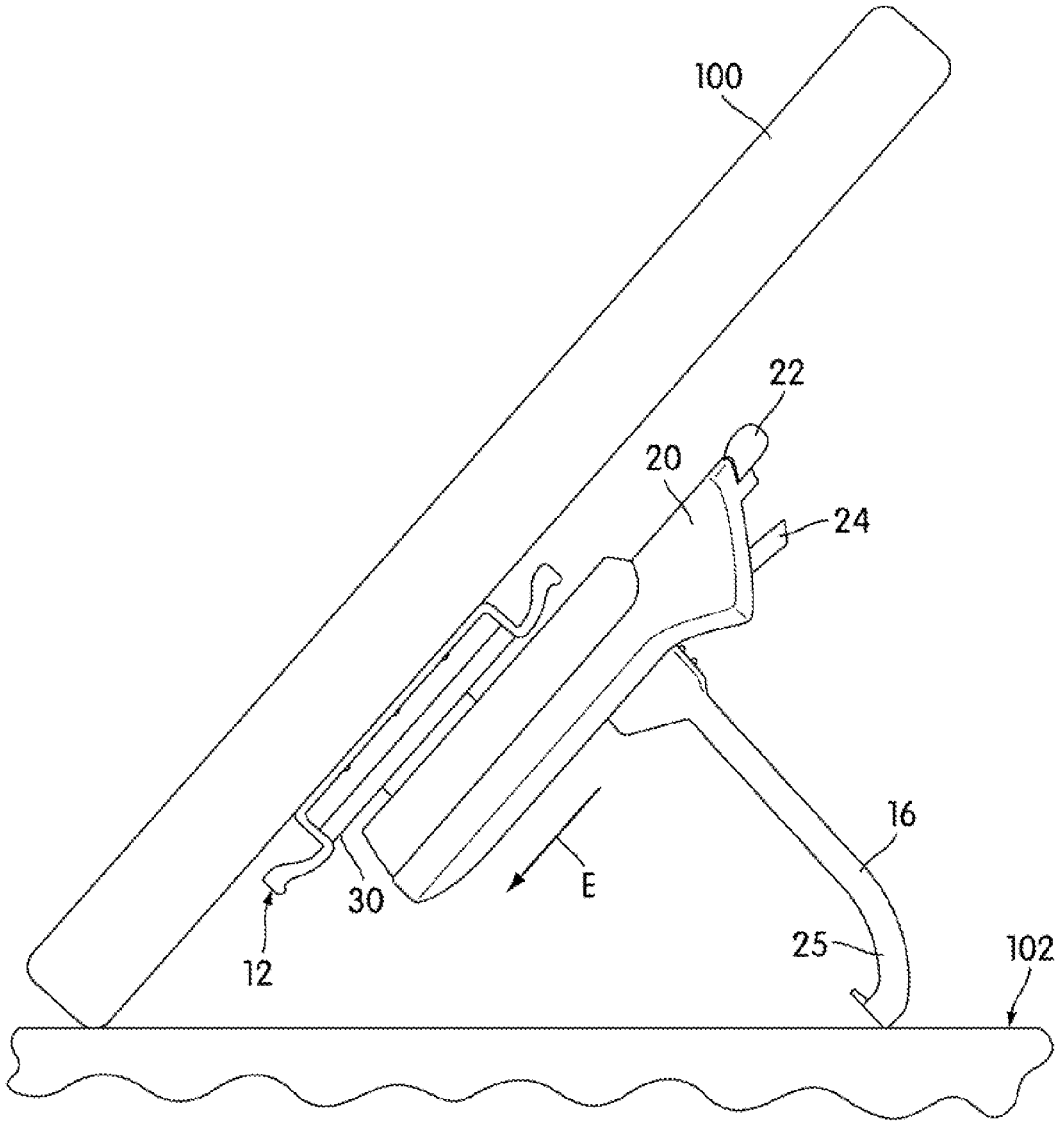
FIG. 12A illustrates a side view of the clip device in a second longitudinal and pivoted position on a surface with an electronic device attached thereto in a partially vertical position in accordance with an embodiment.
Figure 12B:
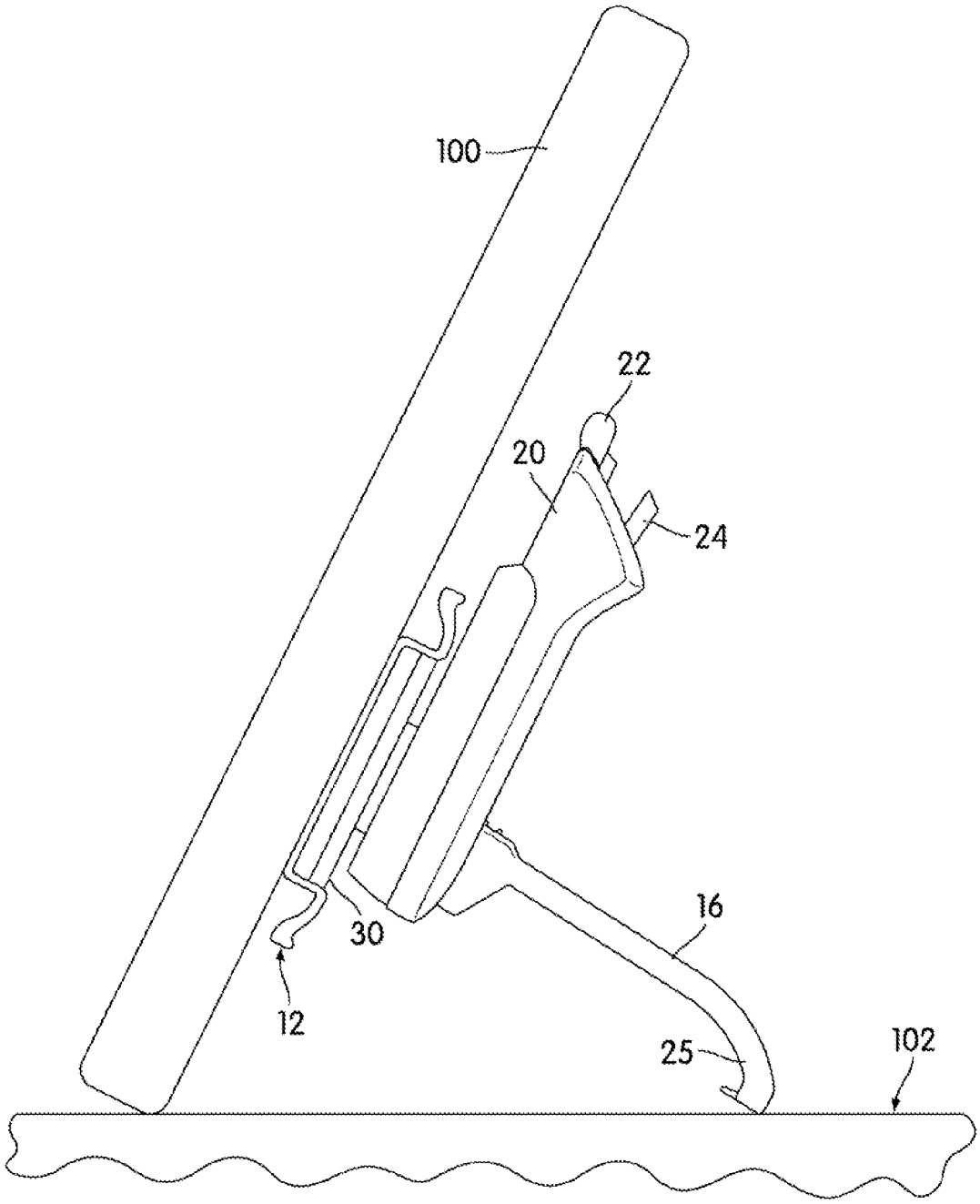
FIG. 12B illustrates a side view of the clip device in a third longitudinal and pivoted position on a surface with an electronic device attached thereto in a partially vertical position in accordance with an embodiment.

FIGS. 10-12B illustrate side views of the clip device 10 of FIGS. 1-6 and an electronic device 100 attached together. As noted above, electronic device 100 may comprise known, portable devices such as a cellular (cell) phone, PDA, MP3 player, etc. As shown in FIGS. 12A and 12B, the clip device 10 may also be positioned on a flat surface 102 for viewing in one or more partially vertical or inclined positions as described below. Alternatively, as previously described, the clip device 10 may be attached to a case, and the case attached to the electronic device 100.

The electronic device 100 may be attached to the clip device 10 via mount 12, for example, as shown in FIG. 10. After the device 100 is attached, the arm 16 of the clip mechanism 14 is moveable between a closed and its first longitudinal position, such that it may be pivoted about pivot axis A1-A1 as shown in FIGS. 7-7A, and receive a peripheral edge of an article of clothing at a bottom end 10*b* (e.g., as noted by arrow R in FIG. 7A). As shown and further described below, the clip device 10 allows one to change the viewing angle of the electronic device 100 when the device 100 is positioned on a surface 102 (i.e., such that it may be viewed in multiple positions and/or angles).

In order to display a screen of the electronic device (i.e., which would be on the opposite side of the device 100 as compared to the clip), the clip device 10 may be positioned in one or more second partially vertical or inclined positions with respect to surface 102. As shown in FIG. 11, the contact portion 50 of the release lock 24 at the top end 10*a* is pushed in a direction indicated by arrow B to release the arm 16 of the clip mechanism 14. The arm 16 may then be moved relative to the mount 12 downwardly in a longitudinal direction of the clip device 10, as indicated by arrow C, from its first longitudinal position as shown in FIG. 10 to at least one second longitudinal position. The arm 16 may then be rotated or pivoted in the second longitudinal position about a pivot axis A-A (that is perpendicular to the longitudinal direction of the clip device 10) to a pivoted open position. In some cases, the arm is releasably secured in the pivoted open position by engaging a lock member of the arm 16 with a lock member associated with the clip mechanism 14 and/or viewing position support mechanism 18, as described above. For example, in embodiments, the top portion 26 of the arm 16 is secured by a securement device (e.g., device 60 with engagement edge 64) after rotation in the second longitudinal position. In other embodiments, the top portion 26 of the arm 16 is frictionally secured with respect to its contact with the second part 28. At least a portion of the arm 16 may then be engaged with an upwardly flat facing surface 102, and, if needed, the mount 12 oriented to display the screen of the electronic device in an at least partially vertical viewing position relative to the surface 102.

As shown in FIGS. 12A-12B, a bottom edge on the bottom portion 25 of the arm 16 is positioned such that it contacts the flat surface 102. This may assist in more securely retaining the top portion 26 of the arm 16 in its angled configuration at the one or more second longitudinal positions. For example, the pressure exerted by the weight of the electronic device 100 towards the surface 102 when the clip device 10 is positioned on the surface 102 assists in engagement of the arm with one or more of the securement devices described (e.g., frictional engagement or engagement with ridge(s)).

As previously described, the at least one second longitudinal position may be any number of positions for moving the arm to a second predetermined angle Θ2 along the longitudinal direction or length of the clip device 10. FIGS. 12A and 12B illustrate two example second longitudinal positions. A user may adjust the viewing angle of the screen of the device 100 with respect to the surface 102 by longitudinally moving the arm 16 in the longitudinal direction along the length of the clip device 10, as indicated by arrow E. Though angle Θ2 at which the arm 16 is releasably retained remains the same with regard to the mount 12, the movement of the arm 16 changes the angle at which the electronic device 100 is viewed on the surface 102, as is evident by the example shown in FIG. 12B.

Also, it should be noted that the method of moving the arm along the length of the clip device 10 should not be limiting. For example, the arm may be at least partially pivoted to a pivoted open position about its pivot axis before moving the arm 16 downwardly in a longitudinal direction to a second longitudinal position.

Additionally, the user may also rotate the electronic device 100 (e.g., in a clockwise or counterclockwise position) using the rotatable attachment device 30 of mount 12 to orient the screen of the electronic device 100 at any number of desired angles with respect to the flat surface 102. In an embodiment, the device 10 may also be correspondingly rotated to match the viewing preference of a user. For example, should the electronic device have a feature for sensing the orientation of the device, the electronic device may orient the screen or display horizontally or vertically, depending on a user's viewing preference. For example, the electronic device may be rotated 90 degrees with respect to the mount 12 or clip device 10 so as to turn the screen from a vertical to a horizontal position. Thus, the device 10 allows a user to view the screen according to such preferences.

The above embodiments of clip device 10 allow for a dual function in that a user may use the clip device 10 to assist in allowing the user to position an electronic device with respect to a flat surface and carry the electronic device using the same device 10. The electronic device is also detachable from clip device 10. Further, an embodiment of the clip device 10 allows a user to rotate the electronic device in a clockwise or counterclockwise position, thus enabling one to view the screen at any number of angles or positions (e.g., vertically or horizontally, partially vertical, or inclined position).

The device 10 also allows a user to position an electronic device for use. For example, a user may position the electronic device such that a speakerphone, microphone, or other hands-free feature may be oriented toward the location of the user.

Additionally, the device 10 allows the user to position an antenna of an electronic device (e.g., a cellular phone, GPS device, satellite radio) in an at least partially vertical position so as to optimize reception.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A dual function clip device for use with an electronic device having a screen, the clip device comprising:

a body for receiving the electronic device;

a clip mechanism constructed and arranged to clip onto a peripheral edge of a clothing article of a user;

the clip mechanism comprising an arm having a top portion and a bottom portion, the arm configured to be movable in a longitudinal direction with respect to the body between a first longitudinal position and at least one second longitudinal position;

the arm being pivotally movable (a) in the first longitudinal position such that the top portion of the arm pivots about a pivot axis from a pivoted closed position to a first pivoted open position to receive the peripheral edge of the clothing article at the bottom portion, and (b) in the at least one second longitudinal position such that the top portion of the arm pivots about the pivot axis to at least one second pivoted open position to position the electronic device for viewing using a viewing position support mechanism;

the viewing position support mechanism comprising a release lock which releasably retains the arm in the first longitudinal position, and the viewing position support mechanism being constructed and arranged such that at least the bottom portion of the arm in the at least one second pivoted open position is positioned to engage an upwardly facing flat surface and orient the body for supporting the electronic device in a viewing position to display the screen on the electronic device.

2. The dual function clip device according to claim 1, wherein the pivot axis of the arm is perpendicular to the longitudinal direction of the clip device.

3. The dual function clip device according to claim 1, wherein the clip device comprises a top end and a bottom end, and wherein the arm moves downwardly in the longitudinal direction towards the bottom end of the clip device when moved from the first longitudinal position to the at least one second longitudinal position.

4. The dual function clip device of claim 1, wherein the release lock of the viewing position support mechanism is provided near the top portion of the arm.

5. The dual function clip device of claim 1, wherein the release lock comprises lock members on the arm which are cooperatively engaged with receiving members on the clip mechanism.

6. The dual function clip device of claim 1, wherein the viewing support mechanism comprises a securement device for securing the arm in one of the at least one second longitudinal positions, and wherein the arm is configured to be pivoted such that the top portion of the arm is secured by the securement device.

7. The dual function clip device according to claim 6, wherein the arm comprises at least one ridge at the top portion and the securement device comprises an engagement member, and wherein pivoting of the arm about the pivot axis to the at least one second longitudinal position engages the at least one ridge of the arm with the engagement member.

8. The dual function clip device according to claim 1, wherein the release lock biases the pivoting of the arm about the pivot axis to a first predetermined angle with respect to the body.

9. The dual function clip device according to claim 1, wherein the arm is pivoted to a second predetermined angle with respect to the body in the at least one second longitudinal position.

10. The dual function clip device according to claim 1, further comprising a slide release device for attaching the body to the clip mechanism, and wherein the electronic device is removable with the body from the clip mechanism via moving the slide release device in the longitudinal direction.

11. The dual function clip device according to claim 1, wherein the body comprises a rotatable attachment device that allows the electronic device to be rotated with respect to the body.

12. The dual function clip device according to claim 11, wherein the body is removably attached to the clip mechanism via the rotatable attachment device.

13. An attachment device for a portable electronic device having a screen, the attachment device comprising:

a body for receiving the electronic device;

a clip mechanism attached to the body, the clip mechanism constructed and arranged to clip onto an edge of a clothing article and comprising an arm that is movable relative to the body;

a viewing position support mechanism configured to allow movement of the arm relative to the body in a longitudinal direction and pivotally about a pivot axis, the arm and its pivot axis configured to be moved in the longitudinal direction between a first longitudinal position and at least one second longitudinal position, and wherein the first longitudinal position allows for pivoting of the arm to a first predetermined angle with respect to the body about the pivot axis to allow the clip mechanism to receive the clothing article, and wherein the at least one second longitudinal position allows for pivoting of the arm to a second predetermined angle with respect to the body about the pivot axis, such that when the clip device is positioned on an upwardly facing flat surface, the body is oriented to display the screen of the electronic device at an angle with respect to the surface.

14. The attachment device of claim 13, wherein the arm comprises pin members for cooperatively engaging with receiving members associated with the clip mechanism to releasably retain the arm in the first longitudinal position.

15. The attachment device according to claim 13, wherein the viewing position support mechanism comprises a securement device for securing the arm in the at least one second longitudinal position, and wherein the arm is secured by the securement device at a top portion thereof.

16. The attachment device according to claim 15, wherein the arm comprises at least one ridge that is rotatable about the pivot axis and the securement device comprises an engagement member, and wherein the pivoting of the arm about the pivot axis to the at least one second longitudinal positions engage the at least one ridge of the arm with the engagement member.

17. The attachment device according to claim 14, wherein the viewing position support mechanism comprises a plurality of longitudinal channels, and wherein the pin members are movable longitudinally within the channels when the arm and its pivot axis are moved in the longitudinal direction to the at least one second longitudinal position.

18. The attachment device according to claim 13, further comprising a slide release device for attaching the body to the clip mechanism, and wherein the electronic device is removable with the body from the clip mechanism via moving the slide release device in the longitudinal direction.

19. An attachment device according to claim 13, wherein the body comprises a rotatable attachment device that allows the electronic device to be rotated with respect to the body.

20. A method for displaying a screen of an electronic device using a clip device constructed and arranged to clip onto a peripheral edge of a clothing article of a user, the clip device comprising a body, a clip mechanism with a movable arm for receiving the clothing article, and a viewing position support mechanism, the method comprising:

mounting an electronic device on the body of the clip device;

moving the movable arm in a longitudinal direction downwardly relative to the body from a first longitudinal position to a second longitudinal position, the first longitudinal position of the arm configured to allow the clip mechanism to receive the peripheral edge of the clothing article;

pivoting the movable arm in the second longitudinal position about a pivot axis to a pivoted open position, the pivot axis being perpendicular to the longitudinal direction;

releasably securing the arm in the pivoted open position by engaging a first lock member of the arm with a second lock member associated with the viewing position support mechanism;

engaging the arm with an upwardly facing flat surface, and orienting the body to display the screen of the electronic device in an at least partially vertical viewing position relative to the upwardly facing flat surface.

21. The method according to claim 20, wherein the movable arm is pivoted to a predetermined angle with respect to the body in the pivoted open position.

22. The method according to claim 20, further comprising releasing the movable arm from the first longitudinal position by releasing a release lock provided adjacent a top portion of the arm.

23. The method according to claim 20, wherein the body comprises a rotatable attachment device that allows the electronic device to be oriented and rotated with respect to the body.

* * * * *